US006477257B1

(12) United States Patent
Chang

(10) Patent No.: US 6,477,257 B1
(45) Date of Patent: Nov. 5, 2002

(54) DIRECTIONAL MICROPHONE

(76) Inventor: Chao-Chih Chang, No. 43, Tung-Nan St., Tung Dist., Taichung City (TW)

( * ) Notice: Subject to any disclaimer, the term of this patent is extended or adjusted under 35 U.S.C. 154(b) by 195 days.

(21) Appl. No.: 09/690,469

(22) Filed: Oct. 18, 2000

(51) Int. Cl.[7] ..... H04R 25/00
(52) U.S. Cl. ..... 381/356; 381/355; 381/357; 381/360
(58) Field of Search ..... 381/170, 171, 381/177, 355, 356, 357, 360, 361, 369, FOR 147, FOR 148

(56) References Cited

U.S. PATENT DOCUMENTS 5,781,644 A * 7/1998 Chang ..... 381/355
6,130,952 A * 10/2000 Akino et al. ..... 381/360

* cited by examiner

*Primary Examiner*—Sinh Tran
*Assistant Examiner*—Suhan Ni
(74) *Attorney, Agent, or Firm*—Finnegan, Henderson, Farabow, Garrett & Dunner, L.L.P.

(57) ABSTRACT

A directional microphone includes a yoke, and a magnet and a washer disposed in the yoke. An annular cap body encloses a surrounding wall portion of the yoke, and has a plurality of first air passages extending from a front portion through a rear portion of the cap body and are angularly spaced apart from each other, and second air passages formed in the front portion and having radial first sections and axial second sections. A voice coil is disposed around the washer and the magnet within the yoke. A diaphragm is disposed adjacent to the front portion of the cap body and is connected to the voice coil. A protective cover has an annular surrounding wall coupled to the front portion of the cap body without covering the second air passages, and a perforated cover plate disposed proximate to the diaphragm. An air chamber unit is coupled to the rear portion of the cap body and is in communication with the first air passages. The rear portion of the cap body has an outer wall surface formed with a guide groove unit and a plurality of recesses for inter-communicating the second air passages and the guide groove unit.

6 Claims, 6 Drawing Sheets

DIRECTIONAL MICROPHONE

BACKGROUND OF THE INVENTION

1. Field of the Invention

The invention relates to a directional microphone, more particularly to a directional microphone with superdirectional characteristics, which is simple and inexpensive to manufacture.

2. Description of the Related Art

A typical sound amplification system minimally requires a microphone, an amplifier and a loudspeaker for amplification and output of sounds. In operation, the microphone converts audio signals into electrical signals, which are amplified by the amplifier for transmission to the loudspeaker. The loudspeaker then converts the amplified signals into sounds for emission. In such a system, if the microphone does not have directional characteristics, it will pick up sound from all directions with equal sensitivity, which may create undesirable feedback that causes the loudspeaker to produce high-pitch noise. A directional microphone was developed in order to effectively suppress the feedback phenomenon.

The so-called directional microphone refers to one that has a notably low sensitivity with respect to sound from a particular direction. By virtue of the directional characteristics, sound from the particular direction can be suppressed to prevent feedback and hence high-pitch noise. For a unidirectional microphone, the sensitivity of the microphone is exceptionally low within a range of 180 degrees (the direction facing the microphone being 0 degree). Therefore, the unidirectional microphone is suitable for use on occasions in which the loudspeaker is disposed opposite to the user, and is not suitable for use on a stage as there will be serious feedback. There has been developed a type of superdirectional microphone that is especially adapted for use on a stage. During a live stage performance, the loudspeakers will not be arranged directly opposite the front of the stage, but will be disposed on both sides of the stage (forming a 120-degree directivity). Hence, the superdirectional microphone can reject sound signals from the 120-degree range and can hence suppress noise feedback.

FIGS. 1 and 2 show a microphone of the prior art. As illustrated, the microphone includes a protective cover 1, a sponge 101 disposed inside the protective cover 1, a voice coil 2, a diaphragm 3, a washer 4, a magnet 5, a yoke 6, an annular cap 7, and an air chamber unit 8. During manufacture, the washer 4, the magnet 5 and the yoke 6 are first assembled. The cap body 7 is formed integrally with the resulting assembly and simultaneously with a high-frequency resonance pad 701 as a plastic encapsulation by injection molding. The cap body 7 is also formed simultaneously with a plurality of through air chamber holes 702 and a plurality of lateral air holes 703. The air chamber holes 702 are pre-determined to be communicated with the air chamber unit 8. The lateral air holes 73 are communicated with radial air holes 704 in the lateral sides of the cap body 7. Next, the voice coil 2, the diaphragm 3, and the protective cover 1 are mounted in sequence on the front portion of the washer 4. Thereafter, an outer first sound regulating paper 9 is attached to surround the cap body 7 and the protective cover 1. Finally, after mounting a second sound regulating paper 901 onto the bottom portion of the cap body 7, the air chamber unit 8 is mounted at the bottom portion of the cap body 7 to complete assembly of the conventional microphone.

Although the above-described microphone can provide higher sensitivity and enhanced structural strength, it is a 180-degree directional microphone that is unsuited for specific occasions, for instance, on stage.

SUMMARY OF THE INVENTION

Therefore, the main object of the present invention is to provide a directional microphone with superdirectional characteristics, and which is simple and inexpensive to manufacture.

Accordingly, a directional microphone of this invention includes a yoke, a magnet, a washer, an annular cap body, a voice coil, a diaphragm, a protective cover, and an air chamber unit. The yoke has a surrounding wall portion with front and rear ends, and an end wall portion disposed to close the rear end of the surrounding wall portion. The magnet is disposed in the yoke, and has a front side and a rear side that lies against the end wall portion of the yoke. The washer is disposed in the yoke, and has a front side and a rear side that lies against the front side of the magnet. The cap body encloses the surrounding wall portion of the yoke, and has a front portion with a front end face, a rear portion with a rear end face, and a plurality of first and second air passages. The first air passages extend from the front end face through the rear end face and are angularly spaced apart from each other. The second air passages are formed in the front portion. Each of the second air passages has a radial first section that extends in a radial inward direction from an outer wall surface of the front portion, and an axial second section that extends from an innermost end of the first section to the front end face. The voice coil is disposed around the washer and the magnet within the surrounding wall portion of the yoke. The diaphragm is disposed adjacent to the front end face of the cap body, and has a peripheral portion connected to the voice coil. The protective cover includes a perforated cover plate and an annular surrounding wall. The annular surrounding wall extends from a periphery of the cover plate, and is coupled to the front portion of the cap body without covering the first sections of the second air passages and with the cover plate disposed proximate to the diaphragm. The air chamber unit is coupled to the rear portion of the cap body and is in communication with the first air passages. The rear portion of the cap body has an outer wall surface formed with a guide groove unit and a plurality of recesses for inter-communicating the first sections of the second air passages and the guide groove unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
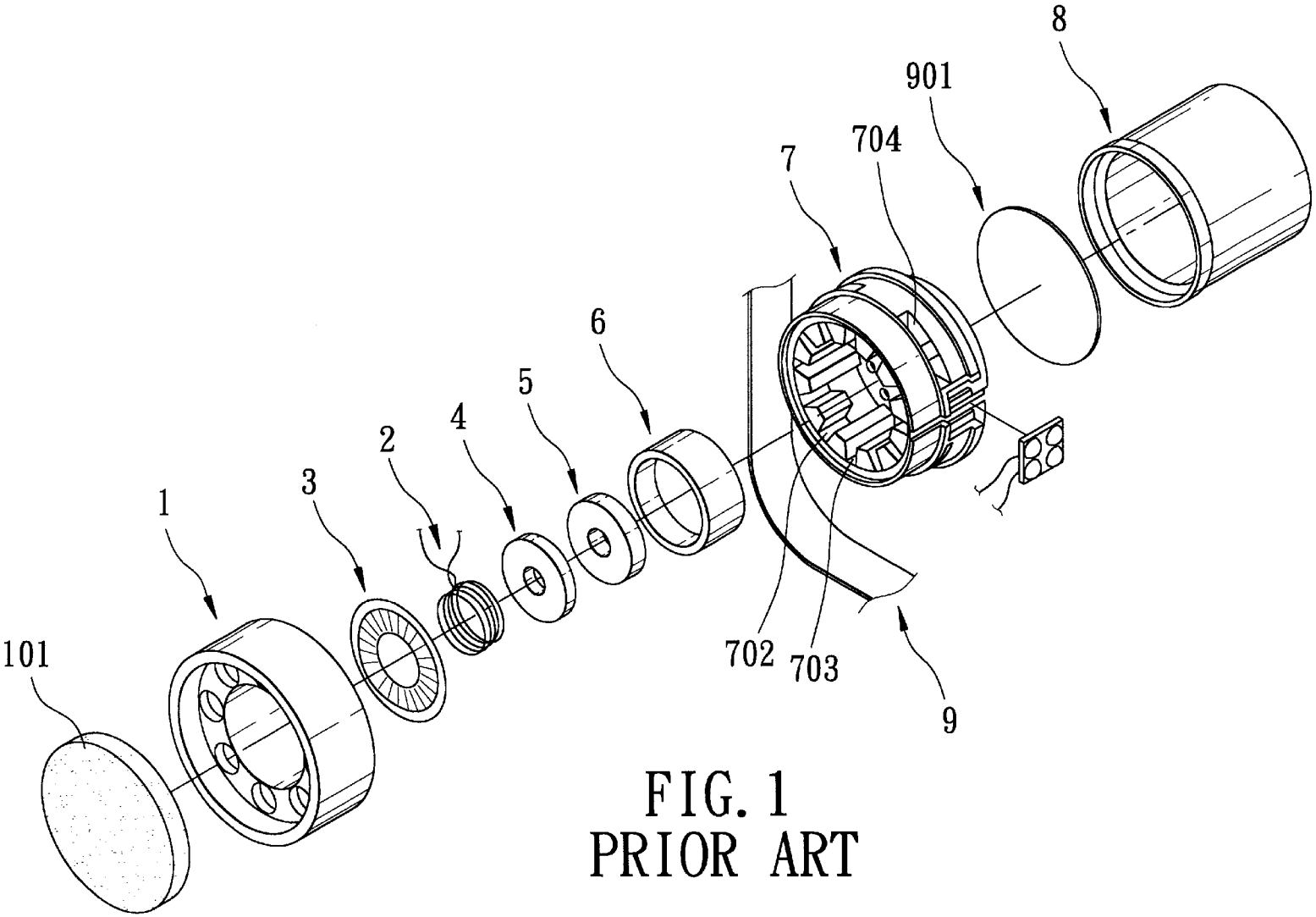
FIG. 1 PRIOR ART
FIG. 1 is an exploded perspective view of a conventional microphone.
Figure 2:
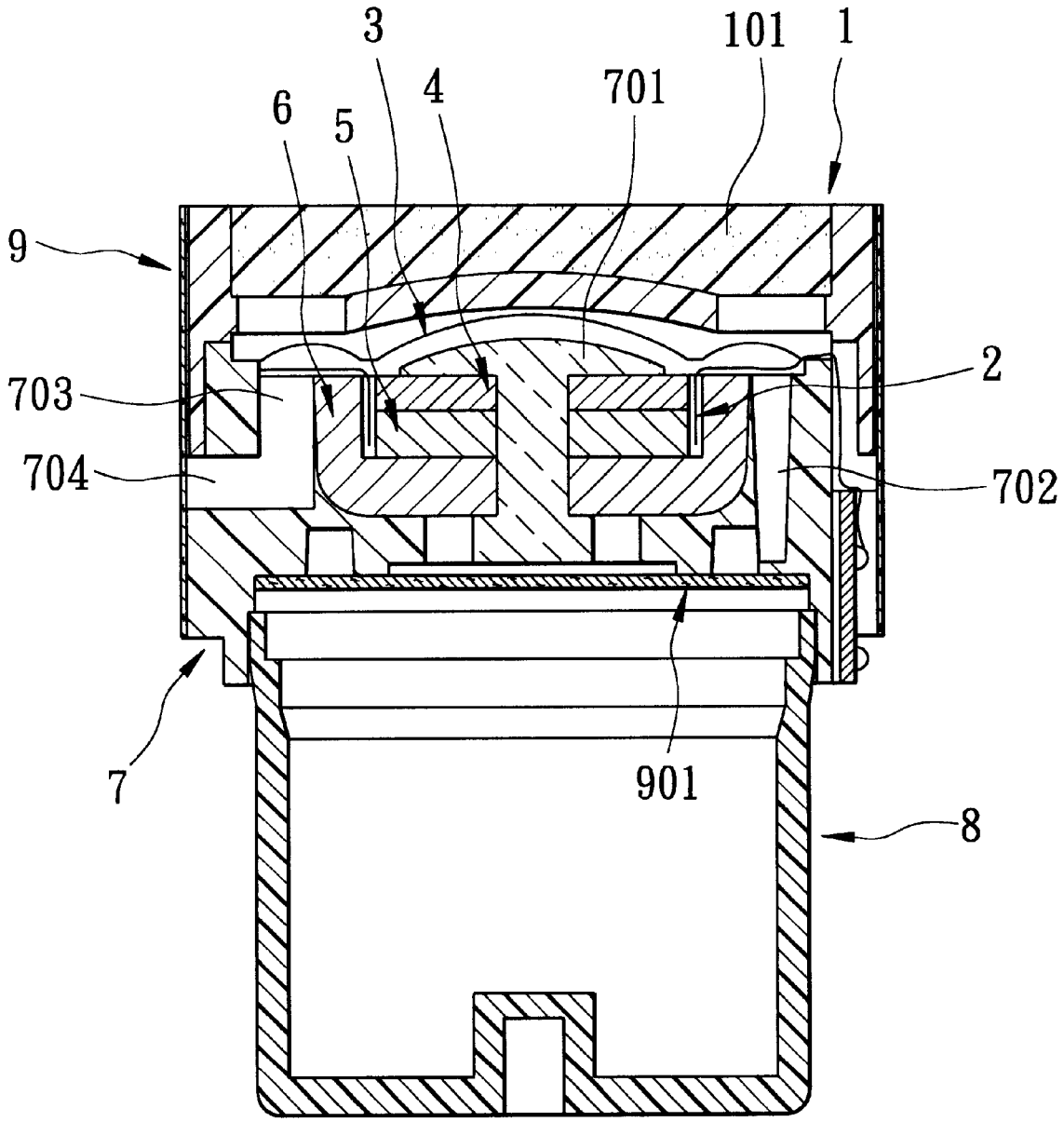
FIG. 2 PRIOR ART
FIG. 2 is an assembled sectional view of the conventional microphone of FIG. 1.
Figure 3:
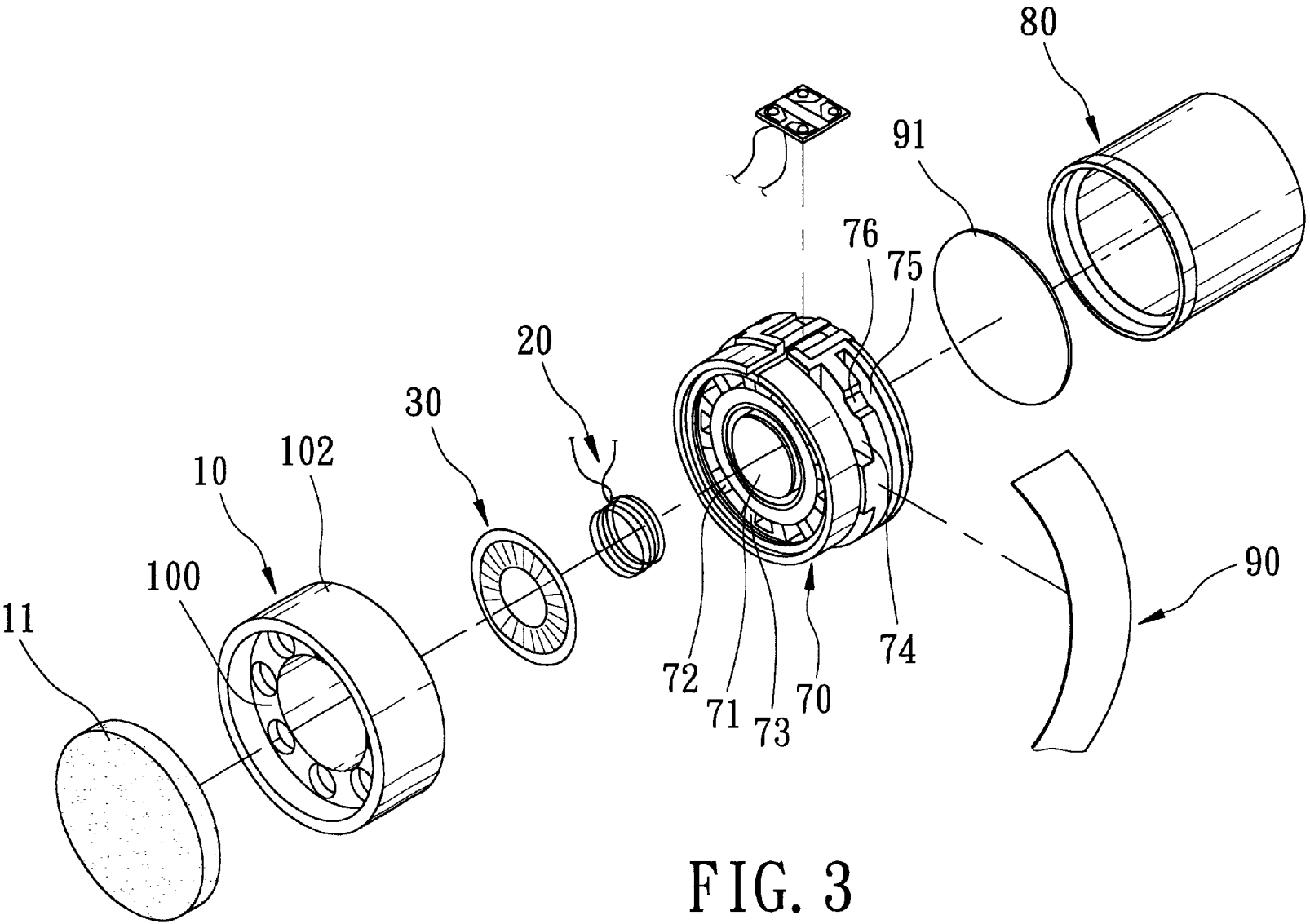
FIG. 3 is an exploded perspective view of the preferred embodiment of a directional microphone according to the invention.
Figure 4:
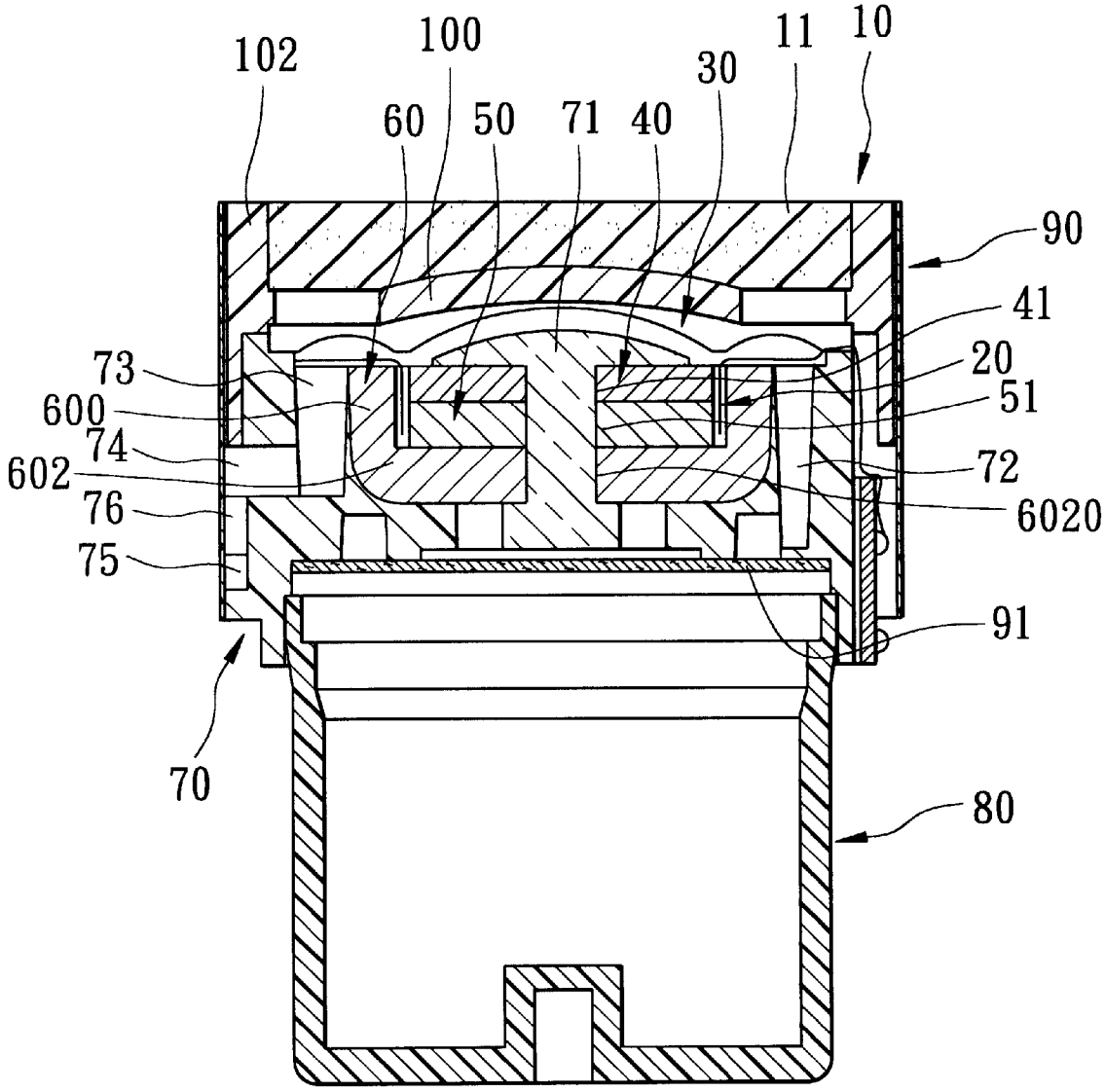
FIG. 4 is an assembled sectional view of the preferred embodiment.

Referring to FIGS. 3 and 4, the preferred embodiment of a directional microphone according to the present invention is shown to include a yoke 60, a washer 40, a magnet 50, an annular cap body 70, a voice coil 20, a diaphragm 30, a protective cover 10, and an air chamber unit 80.

The yoke 60 has a surrounding wall portion 600 with front and rear ends, and an end wall portion 602 disposed to close the rear end of the surrounding wall portion 600.

The washer 40 is disposed in the yoke 60, and has a front side and a rear side that lies against the front side of the magnet 50. The washer 40 further has a first securing hole 41 formed through a central portion thereof.

The magnet 50 is disposed in the yoke 60, and has a front side and a rear side that lies against the end wall portion 602 of the yoke 60. The magnet 50 is formed with a second securing hole 51 that is aligned with the first securing hole 41. The end wall portion 602 of the yoke 60 is formed with a third securing hole 6020 that is aligned with the first and second securing holes 41, 51.

The cap body 70 encloses the surrounding wall portion 600 of the yoke 60, and has a front portion with a front end face, a rear portion with a rear end face, and a plurality of first air passages 72 and second air passages. The first air passages 72 extend from the front end face through the rear end face, and are angularly spaced apart from each other. The second air passages are formed in the front portion. Each of the second air passages has a radial first section 74 that extends in a radial inward direction from an outer wall surface of the front portion, and an axial second section 73 that extends from an innermost end of the first section 74 to the front end face.

The voice coil 20 is disposed around the washer 40 and the magnet 50 within the surrounding wall portion 600 of the yoke 60.

The diaphragm 30 is disposed adjacent to the front end face of the cap body 70, and has a peripheral portion connected to the voice coil 20.

The protective cover 10 includes a perforated cover plate 100 and an annular surrounding wall 102. The annular surrounding wall 102 extends from a periphery of the cover plate 100, and is coupled to the front portion of the cap body 70 without covering the first sections 74 of the second air passages. The cover plate 100 is disposed proximate to the diaphragm 30. A sponge 11 is disposed to lie against a front side of the cover plate 100 within the protective cover 10.

The air chamber unit 80 is coupled to the rear portion of the cap body 70 and is in communication with the first air passages 72.

Furthermore, the rear portion of the cap body 70 has an outer wall surface formed with a guide groove unit 75 and a plurality of recesses 76 for inter-communicating the first sections 74 of the second air passages and the guide groove unit 75. In this embodiment, the guide groove unit 75 is an annular peripheral groove.

The microphone further includes a high-frequency resonance pad 71. The resonance pad 71 is disposed at the front side of the washer 40 and has a securing portion 712 that extends through the first, second and third securing holes 41, 51, 6020. In this embodiment, the cap body 70 is a plastic encapsulation formed simultaneously with the resonance pad 71.

The microphone further includes sound regulating papers 90, 91. The sound regulating paper 90 is attached to and is disposed to surround the protective cover 10 and the cap body 70, whereas the sound regulating paper 91 is attached to the rear end face of the cap body 70.

During the manufacture of the directional microphone of the present invention, the washer 40, the magnet 50, and the yoke 60 are first assembled by superimposing the washer 40 on the magnet 50, which are then disposed in the yoke 60. The resulting assembly is then placed in a mold (not shown) for forming the rear cap 70 integrally with the assembly and together with the resonance pad 71, via an in-situ plastic injection molding process. The first air passages 72 and the second air passages are also simultaneously formed with the rear cap 70. Thereafter, the voice coil 20, the diaphragm 30, and the protective cover 10 are mounted sequentially in the yoke 60. The sound regulating papers 90, 91 are then adhered to the protective cover 10 and the cap body 70, and to the rear end face of the cap body 70, respectively. Lastly, the air chamber unit 80 is coupled to the rear portion of the cap body 70 to be communicated with the first air passages 72.

Figure 5:
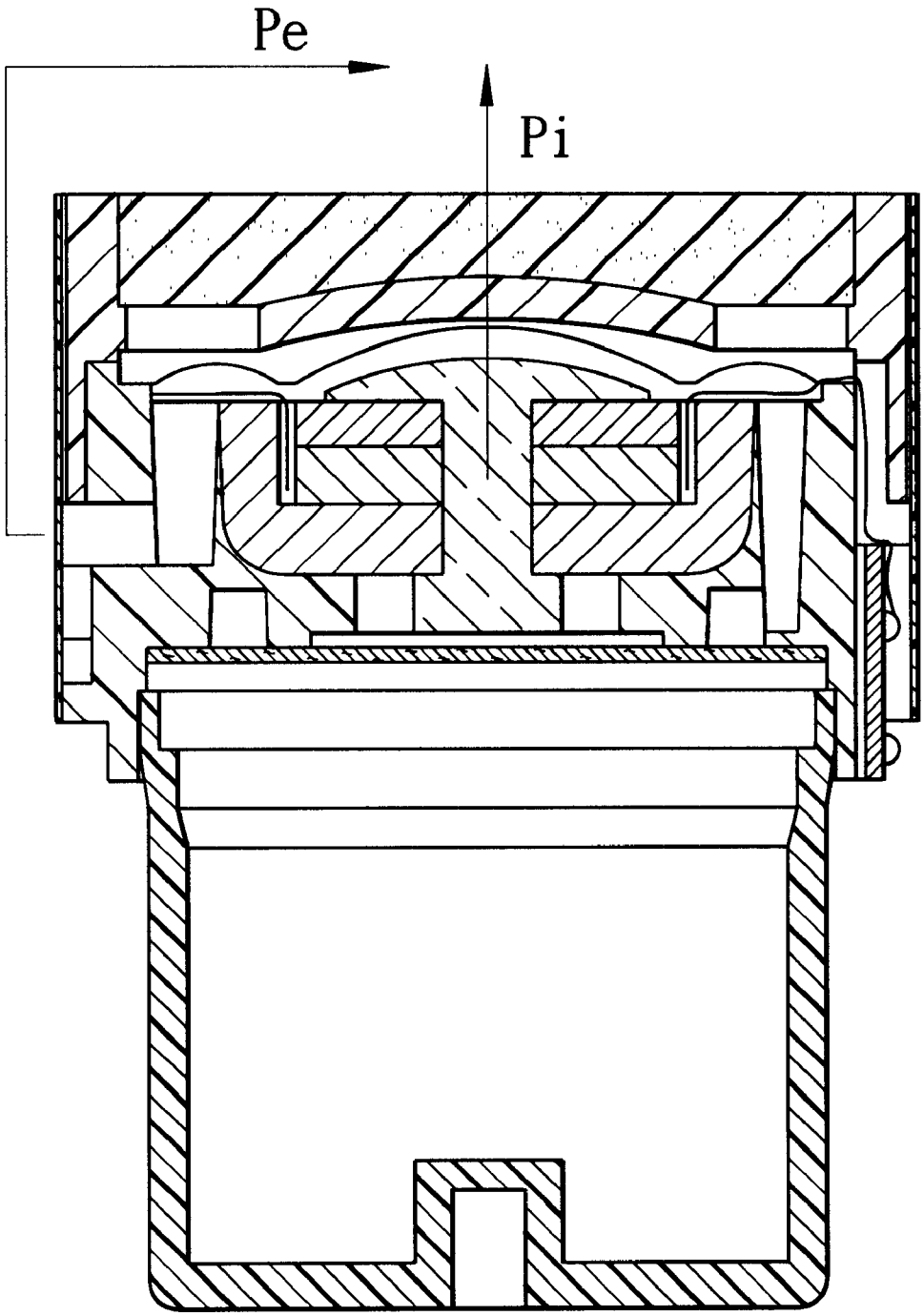
FIG. 5 is a view similar to FIG. 4, illustrating paths of sound pressures when the microphone according to the invention is in use.
Figure 6:
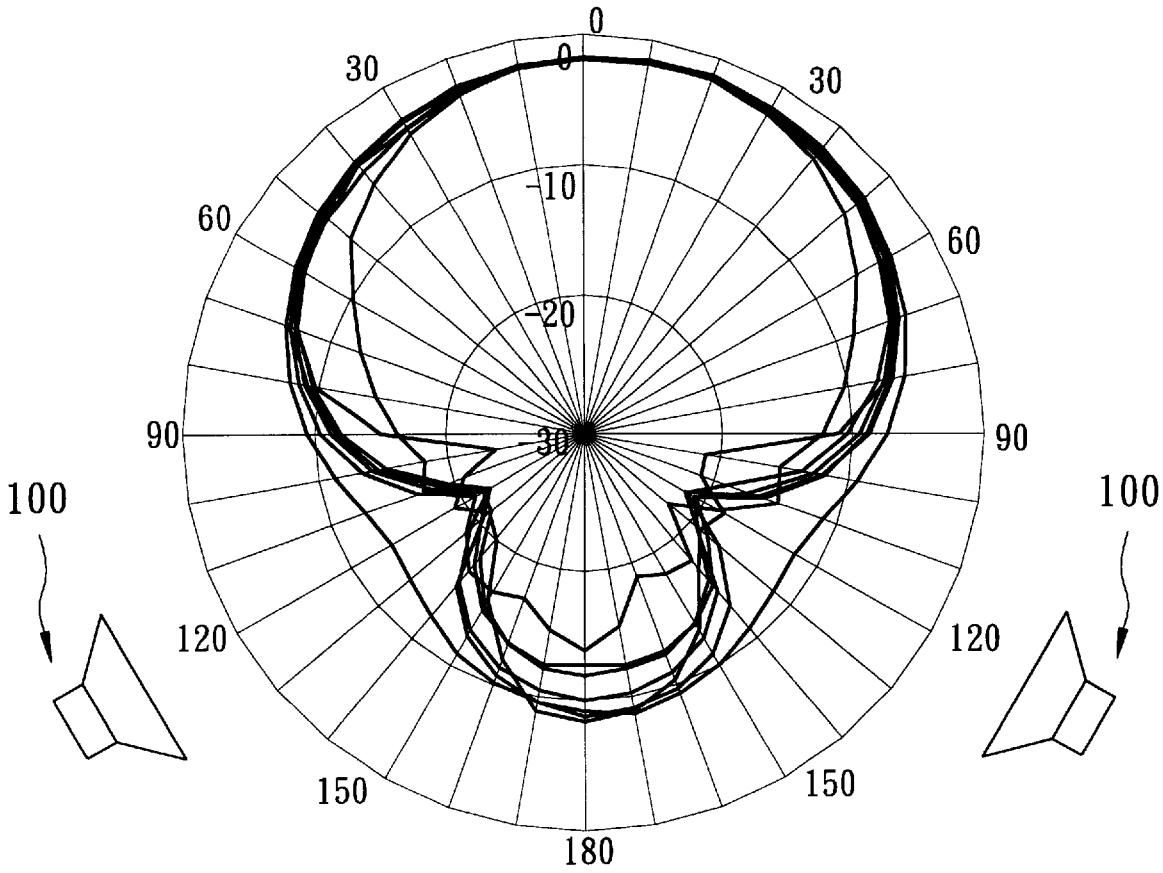
FIG. 6 illustrates the superdirectional characteristics of the preferred embodiment when used on stage.

Since the cap body 70 is provided with the guide groove unit 75 and the recesses 76, when an incident sound pressure is admitted in the microphone, the diaphragm 30 will be actuated. At this time, referring to FIG. 5, a first sound pressure (Pe) is generated, while a second sound pressure (Pi) is generated by pressure admitted to the diaphragm 30 via the sound regulating paper 90, the guide groove unit 75, the recesses 76, and the first sections 74 of the second air passages, the magnet 50, and the yoke 60. These first and second sound pressures (Pe, Pi) endow the microphone with the so-called phase-shift effect. By selecting the position and size of the first sections 74 of the second air passages, the recesses 76, and the guide groove unit 75, the microphone can have 120-degree directional characteristics to be adapted for use on a stage, where two loudspeakers 100 are generally arranged on both sides of the stage and are spaced apart by an angle of 120 degrees, as shown in FIG. 6.

Thus, according to this invention, a superdirectional microphone with 120-degree directional characteristics can be achieved via a simple and inexpensive manufacturing process.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A directional microphone comprising:

a yoke having a surrounding wall portion with front and rear ends, and an end wall portion disposed to close said rear end of said surrounding wall portion;

a magnet disposed in said yoke, said magnet having a front side and a rear side that lies against said end wall portion of said yoke;

a washer disposed in said yoke, said washer having a front side and a rear side that lies against said front side of said magnet;

an annular cap body enclosing said surrounding wall portion of said yoke and having a front portion with a front end face, a rear portion with a rear end face, a plurality of first air passages that extend from said front end face through said rear end face and that are angularly spaced apart from each other, and a plurality of second air passages formed in said front portion, each of which has a radial first section that extends in a radial inward direction from an outer wall surface of said front portion, and an axial second section that extends from an innermost end of said first section to said front end face;

a voice coil disposed around said washer and said magnet within said surrounding wall portion of said yoke;

a diaphragm disposed adjacent to said front end face of said cap body and having a peripheral portion connected to said voice coil;

a protective cover including a perforated cover plate, and an annular surrounding wall that extends from a periphery of said cover plate and that is coupled to said front portion of said cap body without covering said first sections of said second air passages and with said cover plate disposed proximate to said diaphragm; and an air chamber unit coupled to said rear portion of said cap body and in communication with said first air passages;

said rear portion of said cap body having an outer wall surface formed with a guide groove unit and a plurality of recesses for inter-communicating said first sections of said second air passages and said guide groove unit.

2. The directional microphone of claim 1, wherein said guide groove unit is an annular peripheral groove.

3. The directional microphone of claim 1, further comprising a sound regulating paper attached to and disposed to surround said protective cover and said cap body.

4. The directional microphone of claim 1, further comprising a sound regulating paper attached to said rear end face of said cap body.

5. The directional microphone of claim 1, wherein said washer has a first securing hole formed through a central portion thereof, said magnet being formed with a second securing hole aligned with said first securing hole, said end wall portion of said yoke being formed with a third securing hole aligned with said first and second securing holes, said microphone further comprising a high-frequency resonance pad disposed at said front side of said washer and having a securing portion that extends through said first, second and third securing holes.

6. The directional microphone of claim 5, wherein said cap body is an encapsulation that is formed simultaneously with said resonance pad.

* * * * *